US008083434B1

(12) United States Patent
Gorman et al.

(10) Patent No.: US 8,083,434 B1
(45) Date of Patent: Dec. 27, 2011

(54) PAVEMENT REHABILITATION USING COLD IN-PLACE ASPHALT PAVEMENT RECYCLING

(75) Inventors: Albert Mark Gorman, Menands, NY (US); Paul Anthony Gorman, Loudonville, NY (US); Douglas Jones, Rotterdam, NY (US); John Dearborn, Troy, NY (US)

(73) Assignee: Gorman Bros., Inc., Albany, NY (US)

( * ) Notice: Subject to any disclaimer, the term of this patent is extended or adjusted under 35 U.S.C. 154(b) by 1 day.

(21) Appl. No.: 12/460,042

(22) Filed: Jul. 13, 2009

(51) Int. Cl.
*E01C 7/20* (2006.01)

(52) U.S. Cl. ..... 404/75

(58) Field of Classification Search ..... 404/75, 404/76, 80–82, 90–92; 73/803
See application file for complete search history.

(56) References Cited

U.S. PATENT DOCUMENTS

| | | | | |
|---|---|---|---|---|
| 4,193,636 | A | 3/1980 | Jakob | |
| 4,493,585 | A * | 1/1985 | Axer | 404/102 |
| 4,549,834 | A | 10/1985 | Allen | |
| 4,946,307 | A | 8/1990 | Jakob | |
| 4,974,993 | A | 12/1990 | Crabbi | |
| 5,000,615 | A | 3/1991 | Murray | |
| 5,026,205 | A * | 6/1991 | Gorski et al. | 404/72 |
| 5,026,206 | A * | 6/1991 | O'Connor | 404/77 |
| 5,129,803 | A * | 7/1992 | Nomura et al. | 425/62 |
| 5,405,440 | A | 4/1995 | Green et al. | |
| 5,456,547 | A | 10/1995 | Thomas et al. | |
| 5,639,180 | A * | 6/1997 | Sulosky et al. | 404/17 |
| 5,735,634 | A * | 4/1998 | Ulrich et al. | 404/102 |
| 5,741,085 | A | 4/1998 | Wirtgen | |
| 5,762,446 | A * | 6/1998 | Manatt et al. | 404/75 |
| 6,033,031 | A | 3/2000 | Campbell | |
| 6,238,135 | B1 * | 5/2001 | Rower | 404/84.5 |
| 6,623,207 | B2 | 9/2003 | Grubba et al. | |
| 7,004,675 | B2 | 2/2006 | Wayne | |
| 7,137,305 | B2 | 11/2006 | McKemie et al. | |
| 7,275,890 | B2 | 10/2007 | Thomas et al. | |
| 7,448,825 | B2 | 11/2008 | Kasahara et al. | |
| 7,740,414 | B2 | 6/2010 | Hall et al. | |
| 2005/0009962 | A1 * | 1/2005 | Desin | 524/60 |
| 2009/0052987 | A1 | 2/2009 | Hall et al. | |
| 2010/0074684 | A1 * | 3/2010 | Stockwell et al. | 404/91 |

FOREIGN PATENT DOCUMENTS

WO WO 02/103116 12/2002

* cited by examiner

*Primary Examiner* — Raymond Addie
(74) *Attorney, Agent, or Firm* — Hoffman Warnick LLC

(57) ABSTRACT

A method of cold in-place recycling of asphalt to remediate distressed roads. Asphalt particles obtained by milling the existing asphalt are limited by screening to a maximum size of about one inch length. Asphalt particle size may be established by limiting tooth spacing of the road milling equipment milling head to about 5/16 inch or 8 millimeter spacing intervals. A predetermined proportion of portland cement, water, and asphalt emulsion are added to generated asphalt particles. Portland cement may be deposited onto the existing asphalt prior to milling. The resulting combination is mixed to generate a recycled mix, which may then be discharged onto the road being remediated and further processed, such as by screeding, compacting, and sealing.

19 Claims, 5 Drawing Sheets

PAVEMENT REHABILITATION USING COLD IN-PLACE ASPHALT PAVEMENT RECYCLING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to rehabilitation of asphalt paved roads and highways, and more particularly to a cold, in-place asphalt recycling method of rehabilitating roads and highways.

2. Background of the Invention

Cold in-place recycling of structurally sound but unacceptably cracked asphalt pavements has been used for several decades. This method remediates cracks, which would otherwise promote pavement failure, and delays formation of new cracks in recycled pavement and previously applied hot mix overlays, thereby extending life expectancy of the rehabilitated pavement.

In conventional practice using cold, in-place asphalt recycling, one lane of a distressed pavement is milled on the order of three to five inches deep. A small amount of asphalt emulsion or foamed asphalt is mixed with milled pavement particles or reclaimed asphalt pavement, which will herein be referred to as RAP for brevity. The road surface is then paved with the treated RAP and is subsequently compacted. This operation is carried out directly on pavement being remediated, with no application of heat to reclaimed asphalt.

Milling, treatment of RAP, and paving may be performed by known milling equipment 2, as seen in FIG. 3. Milling is performed with rows of teeth 4 mounted on a milling head 6 which is part of the milling equipment 2, as seen in FIG. 4. Conventional spacing of adjacent rows of teeth 4 is on the order of about six tenths or two thirds of an inch, or about fifteen millimeters. This spacing interval is indicated by the arrow 8.

Although immediate use by traffic may be permitted upon completion of the process, it is preferred to allow curing of the newly remediated pavement to deter rutting and other defects from developing. Municipal authorities usually require a hot mix asphalt overlay to be applied after a curing interval to seal the recycled mix, to improve strength and to oppose intrusion of water into the remediated roadway.

The conventional treatment summarized above has the drawback of requiring the hot mix asphalt overlay. A further undesirable characteristic is that due to layer thickness of the uncompacted asphalt mix, typically on the order of four to seven inches, and due to sizes of reclaimed asphalt particles, which in the prior art are typically one and one half inches, subsequent compaction is difficult even when using relatively heavy rolling equipment. Inadequate compaction leaves pores in the asphalt, which are subject to permeation by water, and air, which will accelerate eventual failure of the pavement. Although the hot mix asphalt overlay provides a seal, which addresses the deficiency of porosity, this seal comes at significant economic cost, potentially more than doubling the cost of remediation. There is also the matter of additional inconvenience to the motoring public as this second construction process causes additional delays and typically causes localized congestion. The project may also require additional paving to make the remediated roadway compatible with intersecting side streets, driveways, and drainage structures due to paving height discrepancies.

SUMMARY OF THE INVENTION

In the present cold in-place asphalt recycling method, milling of the original pavement is modified such that smaller particles result, and depth of penetration into the original asphalt during milling is reduced. Asphalt particles are reclaimed from the existing pavement surface using a milling head with an unconventional tooth spacing. Modification of the asphalt particles into a recycled mix is carefully conducted by screening and weighing the recycled material while in transit in the recycling process, and dispensing additives in proportion to sensed weight. The result of finer particle size enables use of less thick pavement, with consequent more effective and easier compaction, and greater initial mix stability and mix strength. Porosity may be addressed with a treatment using a spray of fog seal emulsion rather than by applying a hot mix asphalt layer.

Consequently, the necessity for a hot mix asphalt overlay may be eliminated, thus significantly decreasing construction time and costs.

It is an object of the invention to improve upon cold in-place recycling methods.

It is another object of the invention to minimize the depth of milling of a road being remediated, which may be required for successful recycling of asphalt.

It is a further object of the invention to minimize time required before a repaved road is ready to bear traffic.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
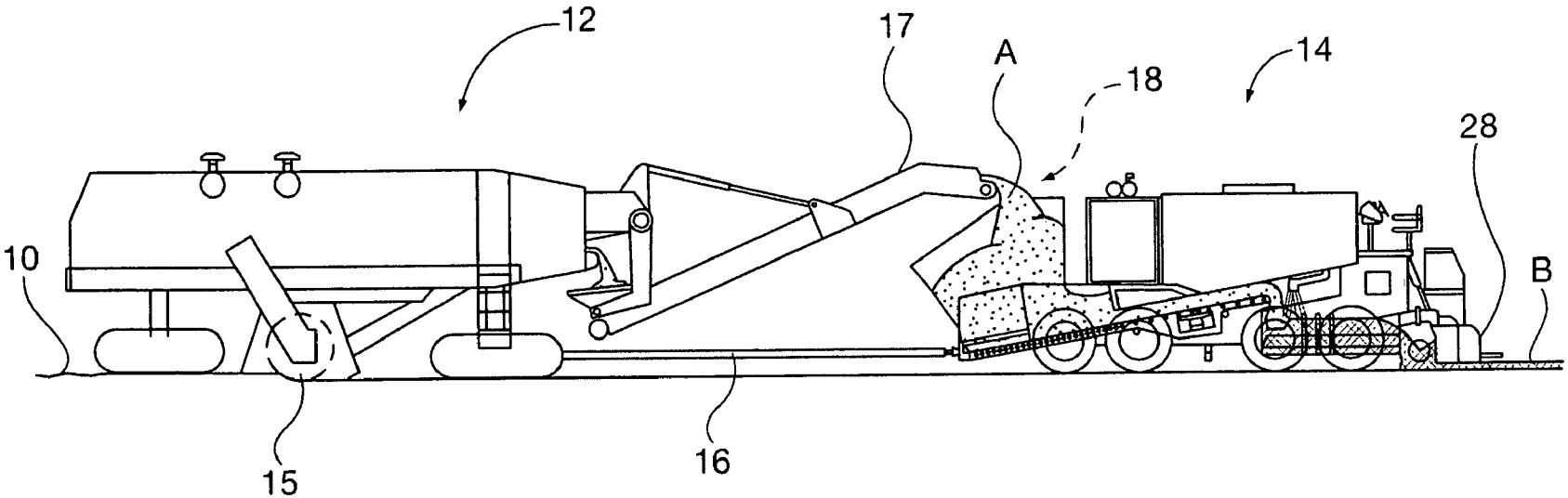
FIG. 1 is a diagrammatic, environmental, side elevational view of equipment which may be used for repaving a road according to at least one aspect of the present invention.

FIG. 1 shows equipment for use in remediation of an existing asphalt surface 10 by a method according to at least one aspect of the present invention. A milling machine 12 having a cutting or milling head 15 (see FIG. 2 for a detailed view) is used to mill the existing asphalt surface 10 to generate asphalt particles referred to herein as "asphalt particles A". The asphalt particles form the basis of recycled asphalt material, which may be returned to the existing asphalt surface 10 in a continuous process.

Figure 2:
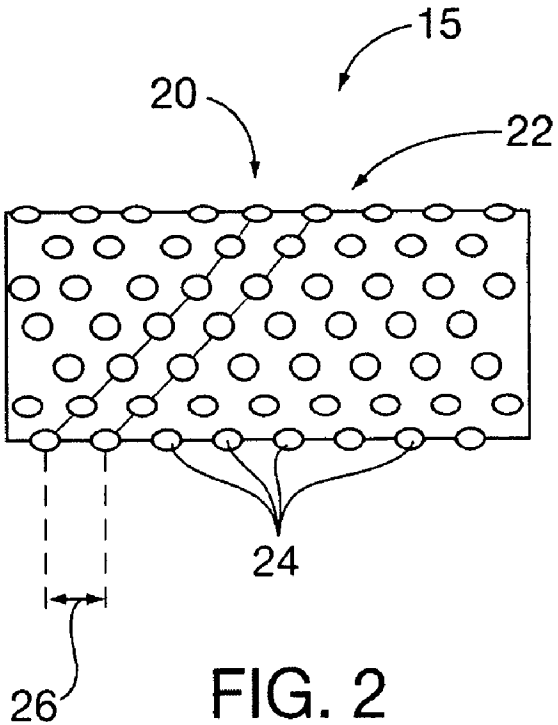
FIG. 2 is an enlarged side elevational detail view of a milling head, which is used with equipment depicted in FIG. 1.
Figure 4:
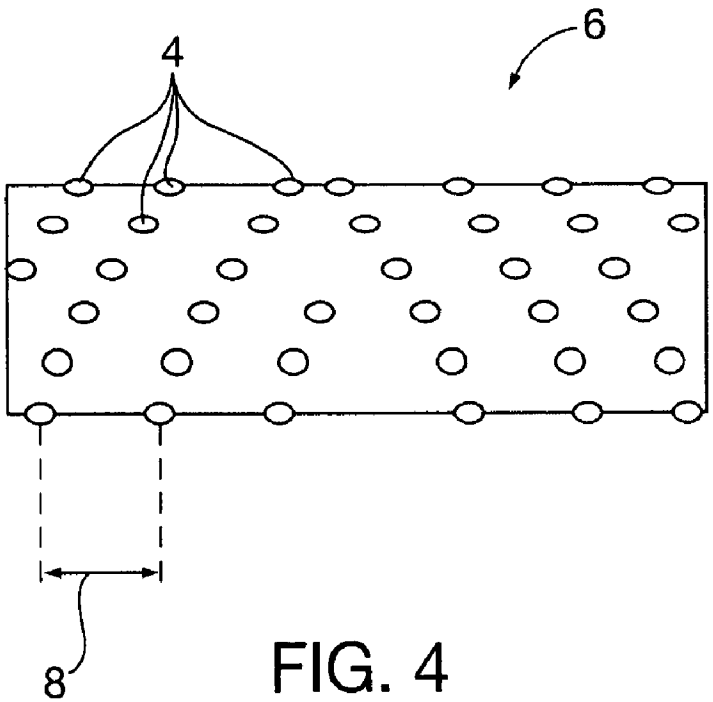
FIG. 4 PRIOR ART
FIG. 4 is an enlarged, side elevational detail view of a prior art milling head, which may be used with the equipment shown in FIG. 3.
Figure 3:
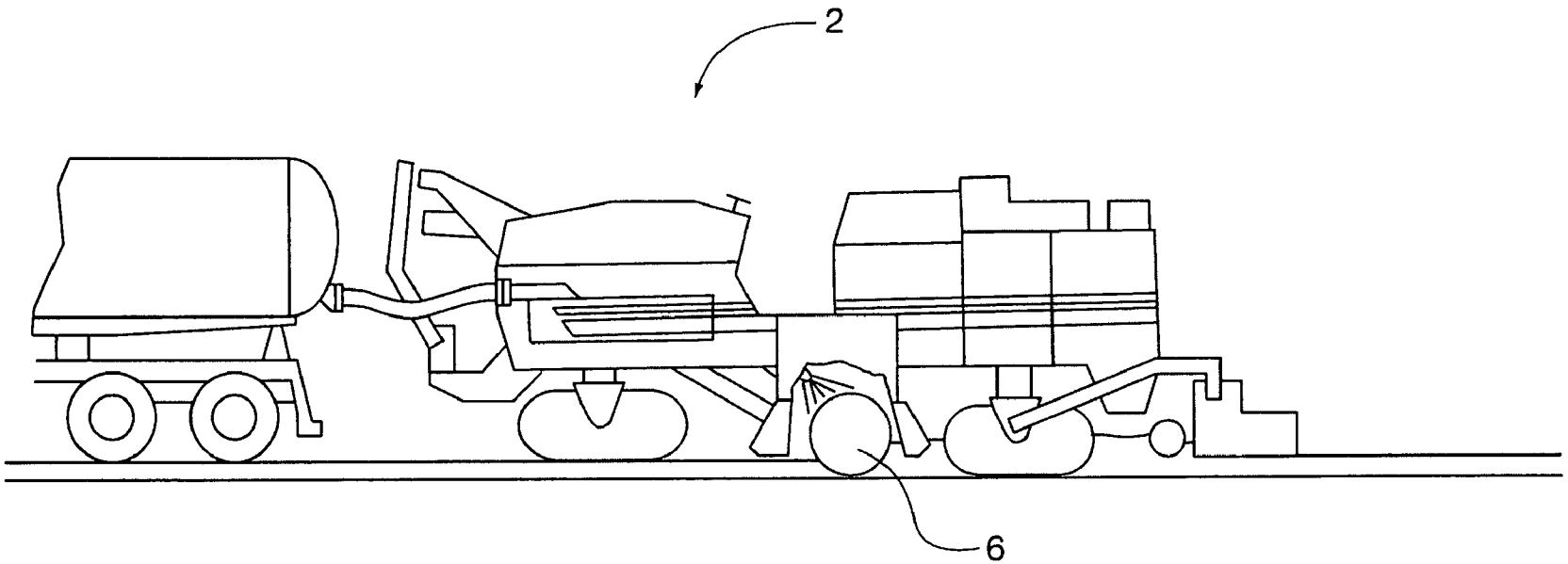
FIG. 3 PRIOR ART
FIG. 3 is a diagrammatic, environmental, side elevational view of equipment used in a prior art method of repaving a road.

Size of particles of RAP obtained by milling is accomplished by using a fine texture milling head, such as the milling head 15 (see FIG. 2). As employed herein, a fine texture milling head is obtained by providing the milling head 15 with rows of teeth 24, such as the rows 20, 22, for example, which rows 20, 22 are spaced apart at intervals of about 8 millimeters or about five sixteenths of an inch. These intervals are indicated in FIG. 2 by the arrow 26. This may be contrasted with the intervals indicated by the arrow 8 in FIG. 4, the intervals in the prior art arrangement typically being on the order of six tenths to two thirds of an inch or fifteen millimeters.

Asphalt particles generated by milling (or "asphalt particles A") are picked up by the milling machine 12 and are subjected to screening to limit the asphalt particles to a maximum size of about one inch in length or diameter. This is accomplished by equipment that is incorporated into the milling machine 14.

A mixing and paving machine 14 may be connected to and drawn by the milling machine 12 by a draw bar 16. The draw bar 16 provides a towing arrangement, which is adapted to draw the mixing and paving machine 14 from the milling machine 12. The mixing and paving machine 14 may comprise first apparatus for mixing the generated asphalt particles, the portland cement, the water, and the asphalt emulsion to generate a recycled mix, referred to herein as "recycled mix B", and second apparatus for discharging recycled mix B for paving. A suitable mixing and paving machine 14 may be, for example, a model Mix-Paver 800, manufactured by Midland Machinery, Inc., of Tonawanda, N.Y.

Portland cement and asphalt emulsion are added in predetermined proportion to the asphalt particles A. This may be performed in two separate processes. Portland cement may be laid down on the existing asphalt surface 10 and wetted by water deposited thereon prior to milling. Wetting both suppresses dust and also furnishes at least some of the water needed for curing of the portland cement. The portland cement may be dispensed by a cement transport vehicle (not shown) having a calibrated cement-dispensing hopper. Water may be dispensed from a water tanker truck (not shown), which may be attached to and pushed along with the equipment used for the recycling process.

Milling and recovery of asphalt particles A will also recover the portland cement and water, which have been deposited onto the pavement. Water may also be sprayed onto the milling head, such as the milling head 15, both to cool the latter and also to supply some of the water for processing the portland cement.

Screening may utilize a vibrating screen deck 18. The vibrating screen deck may comprise, for example, a self-cleaning, single deck screen such as model Flex-Mat3, as manufactured by Major Wire Industries, Limited of Metso Minerals Screening Media (Warrenton, Mo., USA). Screening is arranged to reject asphalt particles of sizes greater than the maximum size from being further processed for recycling.

A predetermined proportion of asphalt emulsion is added to the screened, generated asphalt particles A. The predetermined proportion of asphalt emulsion, and the quantity of portland cement may be determined by two analyses, which may be performed on samples of the existing asphalt surface 10 prior to remediation. A first analysis may determine the properties of the asphalt, for example, gradation, water content, etc. A second analysis may then determine an optimum proportion of portland cement and asphalt emulsion to be added to the existing asphalt surface and the asphalt particles A, respectively, during remediation. The first analysis may comprise performing tests such as quantitative extraction of bitumen from bituminous paving mixtures, which complies with ASTMD 2172-80, and sieve analysis of fine and course aggregates, which complies with ASTMC 136-96. The second analysis may comprise performing a modified Marshall mix design. The Marshall method of mix design complies with ASTM standard D1559, and is modified from the usual procedure in that mixing temperatures are lowered and in that the test mix is heated to expel water from the emulsion. It will be recognized that other tests and analyses exist, which may be substituted for those described herein. The invention encompasses any such tests or analyses, which may be feasibly used to accomplish similar results to those described herein.

These analyses may be performed, for example, in a laboratory, using cores removed from the existing asphalt surface 10 before performing remediation. After determining characteristics of the existing asphalt, these characteristics may be compared to desired characteristics of strength and other properties of pavements, using look up tables, for example, with required amounts of additives, such as portland cement, being determined thereby to establish constituency of the final recycled mix B.

The generated asphalt particles A, the portland cement, the water, and the asphalt emulsion may be mixed in the mixing and paving machine 14 to generate a recycled mix B. The mixing and paving machine 14 may incorporate a belt scale to weigh incoming RAP prior to mixing, so that quantities of additives such as the asphalt emulsion may be controlled and delivered according to the proportions which have been predetermined using the analyses. A computerized weighing belt may be connected to an onboard computer which may be arranged to control dispensing apparatus so as to appropriately proportion the asphalt emulsion relative to the flow of the asphalt particles A.

The recycled mix B may then be deposited onto the milled existing asphalt surface 10 and the surface then finished. Finishing may be accomplished by screeding utilizing a screed device 28, which is typically a part of the mixing and paving machine 14; compacting using conventional rollers; and applying a fog seal emulsion, such as a diluted fog seal emulsion according to standard CSS-1h, which is a specification in compliance with ASTM standard D2397. The rate of application of diluted fog seal emulsion may be limited to about one tenth of a gallon of diluted fog seal emulsion per square yard of surface of the existing asphalt surface being remediated.

Because the novel method exhibits enhanced performance compared to known recycling methods, it becomes possible to limit milling the existing asphalt surface 10 to a depth generally within the range of one and one half to two inches. This advance in the art is achieved due to the novel method discussed herein.

The apparatus used in the above described method, such as the milling machine 12, the mixing and paving machine 14, the cement transport vehicle, the calibrated cement dispensing hopper, the water tanker truck, the roller or compactor which may be used to compact deposited recycled mix B, and the like are generally well known. The invention is not meant to be limited to the exact components or structure of the machines described. The invention encompasses all machinery, which may feasibly carry out the novel method described herein. The milling head 15 and teeth 22 are per se known, although the spacing interval indicated by the arrow 26 is not conventional. The invention does not reside in known apparatus, but rather in the following method 100 which may be practiced using the apparatus described herein.

Figure 5A:
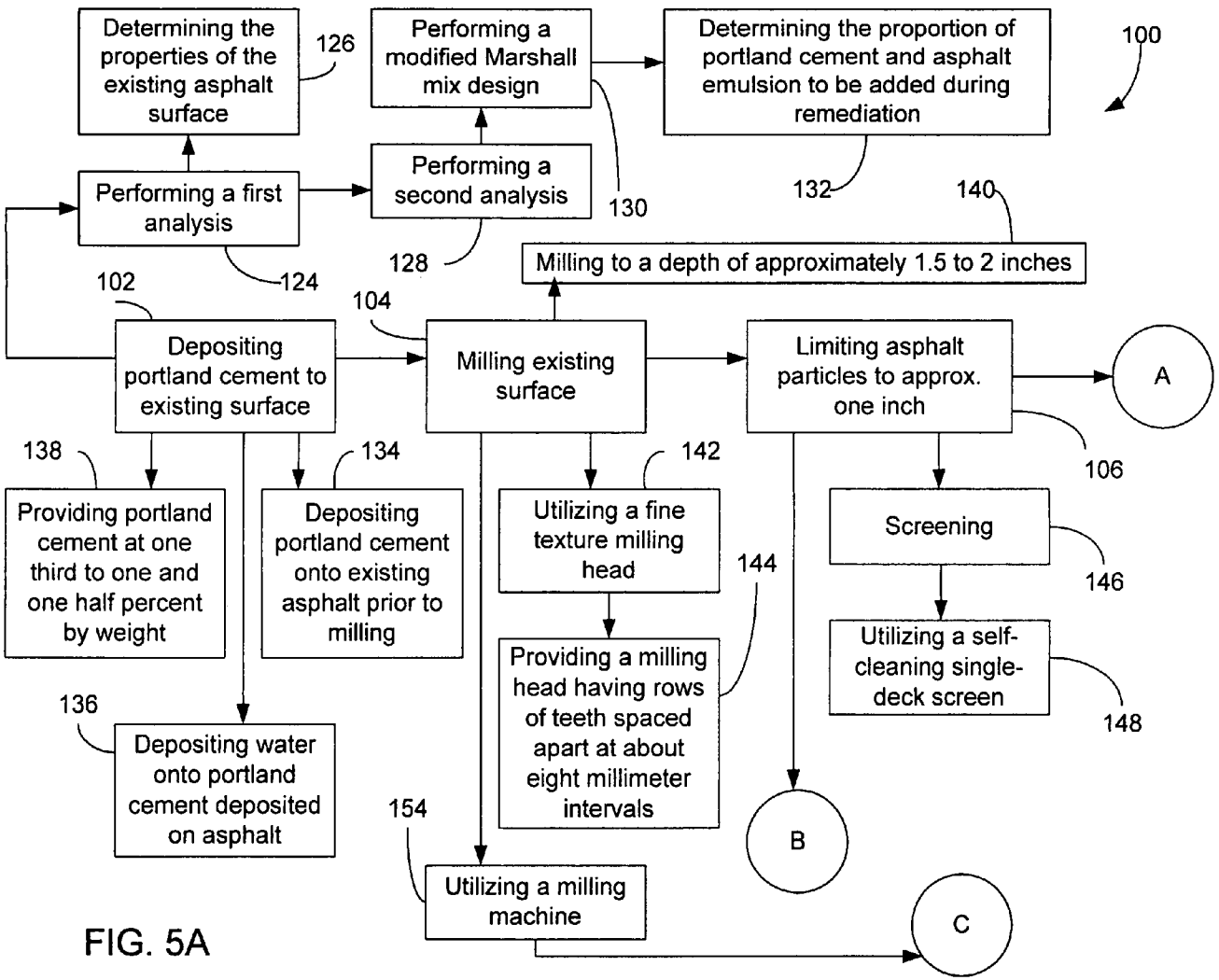
FIG. 5A is a first part of a block diagram showing steps of a method of remediating an existing asphalt surface according to at least one aspect of the present invention.
Figure 5B:
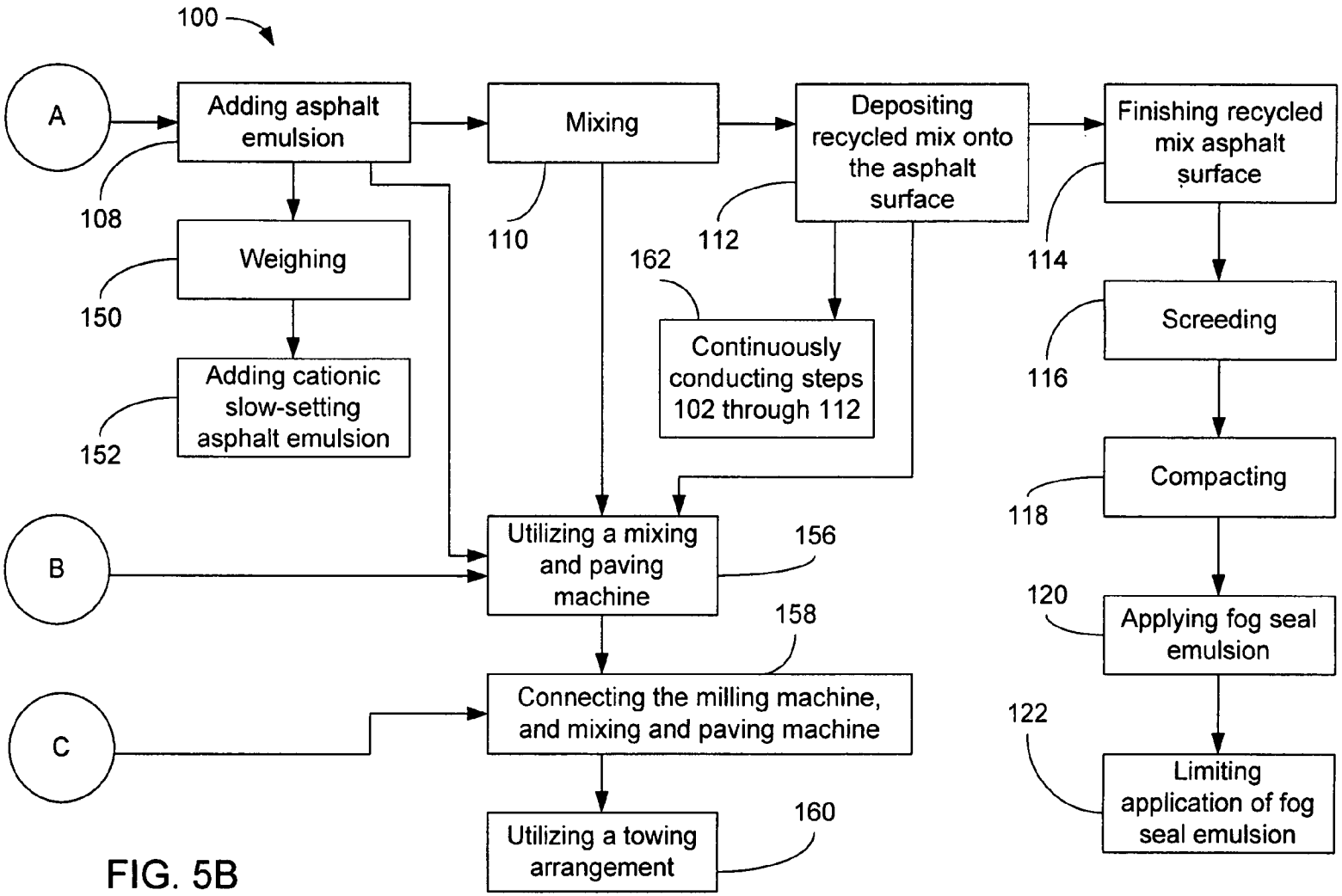
FIG. 5B is a continuation of the partial block diagram of FIG. 5A.

The novel method 100 of remediating an existing asphalt surface such as the asphalt surface 10 using cold in-place recycling of the original asphalt, as summarized in FIGS. 5A and 5B, may comprise a step 102 of depositing a predetermined proportion of portland cement and water to existing asphalt surface; a step 104 of milling the existing asphalt surface to generate asphalt particles; a step 106 of limiting generated asphalt particles to a maximum size of about one inch length; a step 108 of adding a predetermined proportion of asphalt emulsion into the generated asphalt particles; a step 110 of mixing the generated asphalt particles, portland cement, water, and asphalt emulsion to generate a recycled mix, such as the recycled mix B; and a step 112 of depositing the recycled mix B onto the milled existing asphalt surface 10. Final finishing, step 114, of the surface of the recycled mix B may be performed for example in a sub-step 116 of screeding the recycled mix B, followed by a sub-step 118 of compacting the screeded recycled mix B by conventional rollers.

Step 102 comprises depositing a predetermined proportion of portland cement and water to existing asphalt surface. Step 102 may comprise a sub-step 134 of depositing portland cement onto existing asphalt prior to milling. Step 102 may comprise a further sub-step of depositing the water onto portland cement, which has been deposited as a dry granular or powdered product, for example, onto the existing asphalt surface. The step 102 of adding a predetermined proportion of portland cement and water to generated asphalt particles may comprise a further step 138 of providing portland cement at a rate of about one third percent by weight to one and one half percent by weight to the cold in-place recycled asphalt of the existing asphalt surface being remediated.

Step 104 comprises milling the existing asphalt surface (which of course includes the deposited portland cement and water). The step 104 of milling the existing asphalt surface may comprise a further step 140 of milling the existing asphalt surface to a depth generally within the range of one and one half to two inches. The step 104 may also comprise a further sub-step 142 of using a fine texture milling head. The sub-step 142 may comprise a further step 144 of providing a milling head with rows of teeth spaced apart at about 5/16 inch or 8 mm intervals.

The step 106 comprises limiting generated asphalt particles to a maximum size of approximately one inch. Step 106 may comprise the sub-step 146 of subjecting generated asphalt particles, such as asphalt particles A, to a screening process, wherein the screening process is arranged to reject particles of sizes greater than the maximum size from asphalt particles being further processed for recycling. More particularly, this may be accomplished, for example, by performing a step 148 of utilizing a self-cleaning, single deck screen.

The step 108 comprises adding a predetermined proportion of asphalt emulsion to generated asphalt particles A. Step 108 may comprise a sub-step 150 of weighing the generated asphalt particles A. The generated asphalt particles A may move to a weigh-belt (not shown) on the mixing and paving machine 14, where they may be weighed and an associated computer may calculate the amount of asphalt emulsion to be added. The step 108 of adding a predetermined proportion of asphalt emulsion may comprise a further sub-step 152 of adding a predetermined proportion of cationic, slow setting asphalt emulsion into the generated asphalt particles, typically responsive to the weight values and calculations determined in sub-step 150.

Suitable proportions of additives such as the portland cement, water, and asphalt emulsion may be established by prior testing and analysis, before performing the steps 102 . . . 114. The method 100 may be amplified then by incorporating an initial step 124 of performing a first analysis to determine the properties, for example, gradation, water content, etc., of the existing asphalt surface, and a sub-step 126 of determining the properties of the existing asphalt surface. The second analysis is performed to determine the proportion of portland cement and asphalt emulsion to be added during remediation, step 128, which may comprise a sub-step 130 of performing a modified Marshall Mix Design, using samples of generated asphalt particles taken from the existing asphalt surface prior to remediation, wherein the Marshall method of mix design complies with ASTM standard D1559 with the exceptions that mixing temperatures are lowered and that the test mix is heated to expel water from the emulsion. Finally, a sub-step 132 comprises determining proportion of portland cement and asphalt emulsion to be added during remediation.

Reference to first and second analyses for the purpose of determining optimum quantities of portland cement and of asphalt emulsion need not imply two separate analyzing operations. It may be that one analysis enables calculation of appropriate quantities of both portland cement and of asphalt emulsion, and also of total water content. It should also be understood that the terms "first analysis" and "second analysis" are intended only to provide semantic basis for differentiating one analysis from the other, where two separate analysis operations are performed. No inference should be made that any particular order is implied, or that performing the second analysis is necessarily dependent upon first having performed the first analysis.

The step 110 comprises mixing the generated asphalt particles, portland cement, water, and asphalt emulsion to generate a recycled mix, such as recycled mix B. Step 110 may comprise a sub-step of introducing the generated asphalt particles, the portland cement, the water, and the asphalt emulsion into a mixing machine such as the mixing and paving machine 14. The mixing and paving machine 14 may have first apparatus for mixing the generated asphalt particles, the portland cement, the water, and the asphalt emulsion to generate the recycled mix, and second apparatus for discharging recycled mix for paving, for example, in step 112, which comprises depositing recycled mix, such as recycled mix B, onto the asphalt surface. The first and second apparatuses, although not called out specifically by reference numeral, may be functionally equivalent to those, which are provided in a model Mix-Paver 800.

The method 100 may comprise the further step 114 of finishing the recycled mix surface. Finishing step 114 may comprise the further sub-step of screeding 116 which may be performed by screed 28, for example. Finishing step 114 may comprise a further sub-step 118 of, after screeding, compacting the surface, typically using conventional rollers. Finishing step 114 may finally also comprise a sub-step 120 of utilizing fog seal with or applying fog seal emulsion to deposited, screeded, and compacted recycled mix. The fog seal may be in the form of a diluted fog seal emulsion, which complies with a classification CSS-1h, which said classification is in compliance with ASTM standard D2397. The fog seal emulsion may be applied conventionally. Application of the fog seal emulsion into the method 100 may comprise a sub-step 122 of limiting the rate of application of the diluted fog seal emulsion to about one tenth of a gallon of diluted fog seal emulsion per square yard of surface of the existing asphalt surface being remediated.

The method 100 may comprise a further step 154 of utilizing a milling machine such as the milling machine 12 to perform the step of milling the existing asphalt surface to generate asphalt particles, a still further step 156 of utilizing a mixing and paving machine such as the mixing and paving machine 14 to perform the steps of limiting the size of the asphalt particles, adding a predetermined proportion of asphalt emulsion into the generated asphalt particles, and mixing the generated asphalt particles, portland cement, water, and asphalt emulsion to generate a recycled mix, and depositing the recycled mix onto the milled existing asphalt surface, and a still further step 158 of connecting the milling machine 12 to the mixing and paving machine 14 by a conveyor arrangement 17 which is adapted to convey generated asphalt particles from the milling machine 12 directly to the mixing and paving machine 14.

In addition to having the milling machine 12 connected to the mixing and paving machine 14 functionally by the conveyor 17, the milling machine 12 may also be utilized to draw behind it the mixing and paving machine 14, such as by utilizing the draw bar 16. Therefore, the method 100 may comprise a further step 160 of connecting the milling machine 12 to the mixing and paving machine 14 by a towing arrangement, which is adapted to draw the mixing and paving machine 14 by the milling machine 12.

Because the method 100 is intended to be capable of being performed continuously, with many steps being performed simultaneously, the method 100 may comprise a further step 162 of continuously conducting, as remediating the existing asphalt surface proceeds, the previously recited steps of depositing a predetermined proportion of portland cement and water to existing asphalt surface (step 102), milling the existing asphalt surface to generate asphalt particles (step 104), limiting asphalt particles in size (as recited in the step 106), adding a predetermined proportion of asphalt emulsion into the generated asphalt particles (step 108), mixing the generated asphalt particles, portland cement, water, and asphalt emulsion to generate a recycled mix (step 110), and depositing the recycled mix onto the milled existing asphalt surface (step 112). However, as indicated in step 150, weighing may be conducted onboard the mixing and paving machine 14. By this expedient, the recycled mix B need not be removed from the milling, mixing, and paving equipment for assessment or for adjustment of constituency. Rather, weighing may be conducted to implement the optimum constituency of portland cement and water to be added to the generated asphalt particles of the recycled mix as determined by the analysis which establishes optimum portland cement constituency in light of the characteristics of the sampled asphalt. Therefore, continuous recycling and paving are enabled.

It will be recognized that water provided in the step of adding a predetermined proportion of portland cement and water to generated asphalt particles may come from the asphalt emulsion in whole or in part. However, it is preferred to provide at least some of the water in a step of spraying water onto deposited portland cement as this will tend to suppress dust which might otherwise result during subsequent operations such as milling and lifting milled particulate asphalt being recycled.

The order in which the steps of the novel method or its variants are practiced may be modified to suit conditions and demands of the variants of the novel method. Therefore, no inference should be made that recitation of steps in any particular order limits the order in which steps may actually be performed. Similarly, steps may be omitted where feasible or modified according to procedures not set forth herein.

It will also be recognized that the steps of the novel method are not limited to being carried out on or by the machines, or components thereof, described herein. The present invention encompasses any machines or components which may be feasibly substituted for those described herein, and the steps are not limited to being performed on the machines or components thereof described herein.

The present invention is susceptible to additional modifications and variations, which may be introduced thereto without departing from the inventive concepts. For example, although reference has been made to rows 20, 22 of teeth 24 in the milling head 15, provision of an array of teeth 24 not arranged in conspicuous rows while still adhering to the spacing described herein would be considered equivalent to spacing rows such as the rows 20, 22 apart as described.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

We claim:

1. A method comprising:

remediating an existing asphalt surface course layer, overlying a binder course layer, a base course layer and a subbase course layer, using cold in-place recycling of original asphalt of the asphalt surface course layer, the remediating including:

depositing a predetermined proportion of portland cement and water onto the existing asphalt surface course layer;

milling the existing asphalt surface course layer one and one half to two inches deep so as not to penetrate the underlying binder course layer, to generate asphalt particles, the existing asphalt surface course layer including the deposited portland cement and the water, wherein the binder course layer, the base course layer and the subbase course layer are preserved during the milling of the existing asphalt surface course layer;

collecting the generated asphalt particles;

filtering the generated asphalt particles to provide filtered asphalt particles, wherein the filtered asphalt particles are individually limited to a maximum size of about one inch length during the filtering;

adding a predetermined proportion of asphalt emulsion to the filtered asphalt particles;

mixing the filtered asphalt particles, and the asphalt emulsion to generate a recycled mix;

depositing the recycled mix onto at least one of the binder course layer or an unmilled portion of the existing asphalt surface course layer; and finishing a new recycled surface course layer created by the deposited recycled mix, previously deposited onto the at least one of the binder course layer or the unmilled portion of the existing asphalt surface course layer, wherein the milling of the existing asphalt surface course layer is performed with a milling head with teeth spaced apart at intervals of about eight millimeters, wherein the teeth are arranged in diagonally oriented rows.

2. The method according to claim 1, wherein the filtering includes subjecting the generated asphalt particles to a screening process arranged to reject the generated asphalt particles of sizes greater than the maximum size.

3. The method according to claim 2, wherein the subjecting further includes utilizing a self-cleaning, single deck screen during the screening process.

4. The method according to claim 1, further comprising:

performing a first analysis to determine at least one property of the existing asphalt surface course layer; and determining at least one property of the existing asphalt surface course layer according to the results of the first analysis.

5. The method according to claim 4, further comprising:

performing a second analysis to determine a predetermined proportion of at least one of the portland cement and the predetermined portion of the asphalt emulsion to be added to the existing asphalt surface course layer and the generated asphalt particles, respectively; and determining the predetermined proportion of the at least one of the asphalt emulsion and the predetermined portion of the portland cement to be added to the existing asphalt surface course layer and the generated asphalt particles, respectively, according to the results of the second analysis.

6. The method according to claim 5, wherein the performing of the second analysis includes performing a modified Marshall Mix Design, using samples of the existing asphalt surface course layer prior to remediation, wherein the modified Marshall Mix Design complies with ASTM standard D1559 with exceptions that mixing temperatures are lowered and that the test mix is heated to expel water from emulsion.

7. The method according to claim 5, further including continuously weighing the filtered asphalt particles onboard a weighing belt on the mixing and paving machine to continuously vary the predetermined proportion of the asphalt emulsion, as determined by the second analysis, during the adding of the predetermined proportion of the asphalt emulsion.

8. The method according to claim 1, wherein the finishing includes screeding the recycled mix deposited onto the at least one of the binder course layer or the unmilled portion of the existing asphalt surface course layer.

9. The method according to claim 8, wherein the finishing further includes compacting the deposited and screeded recycled mix deposited on the at least one of the binder course layer or the unmilled portion of the existing asphalt surface course layer.

10. The method according to claim 9, wherein the finishing further includes applying fog seal emulsion to deposited, screeded, and compacted recycled mix.

11. The method according to claim 10, wherein the finishing further includes utilizing a diluted fog seal emulsion which comples with a classification CSS-1h, which said classification is in compliance with ASTM standard D2397.

12. The method according to claim 10, wherein the applying of the fog seal emulsion further includes limiting a rate of application of the diluted fog seal emulsion to about one tenth of a gallon of the diluted fog seal emulsion per square yard of surface of the existing asphalt surface course layer being remediated.

13. The method according to claim 1, wherein the depositing of the predetermined proportion of portland cement and the water to the existing asphalt surface course layer includes providing the portland cement at a rate of about one third percent by weight to one and one half percent by weight to the existing asphalt surface course layer being remediated.

14. The method according to claim 1, wherein the step of adding the predetermined proportion of the asphalt emulsion to the filtered asphalt particles includes repeatedly weighing the filtered asphalt particles and computing the amount of the asphalt emulsion to be added based on the weight of the filtered asphalt particles.

15. The method according to claim 14, wherein the adding of the predetermined proportion of the asphalt emulsion into the filtered asphalt particles further includes adding a predetermined proportion of cationic, slow setting asphalt emulsion into the filtered asphalt particles.

16. The method according to claim 1, wherein the mixing of the filtered asphalt particles, the portland cement, the water, and the asphalt emulsion to generate the recycled mix includes introducing the filtered asphalt particles, the portland cement, the water, and the asphalt emulsion into a mixing and paving machine having a first apparatus for mixing the filtered asphalt particles, the portland cement, the water and the asphalt emulsion to generate the recycled mix, and a second apparatus for discharging the recycled mix for paving.

17. The method according to claim 16, further comprising:

utilizing a milling machine to perform the milling of the existing asphalt surface course layer to generate asphalt particles;

utilizing the mixing and paving machine to perform the filtering of the generated asphalt particles to the maximum size of about one inch length, mixing the filtered asphalt particles, the portland cement, the water, and the asphalt emulsion to generate the recycled mix, adding the predetermined proportion of the asphalt emulsion into the filtered asphalt particles, and depositing the recycled mix onto the at least one of the binder course layer or the unmilled portion of the existing asphalt surface course layer; and connecting the milling machine to the mixing and paving machine by a draw bar in such a way that a conveyor may convey the filtered asphalt particles from the milling machine directly to the mixing and paving machine.

18. The method according to claim 16, further comprising connecting the milling machine to the mixing and paving machine by a towing arrangement which is adapted to drive the mixing and paving machine by the milling machine.

19. A method comprising:

remediating an existing asphalt surface course layer, overlying a binder course layer, a base course layer and a subbase course layer, using cold in-place recycling of original asphalt of the asphalt surface course layer, the remediating including:

depositing a predetermined proportion of portland cement and water onto the existing asphalt surface course layer;

milling the existing asphalt surface course layer so as not to penetrate the underlying binder course layer, to generate asphalt particles, the existing asphalt surface course layer including the deposited portland cement and the water, wherein the binder course layer, the base course layer and the subbase course layer are preserved during the milling of the existing asphalt surface course layer;

collecting the generated asphalt particles;

filtering the generated asphalt particles to provide filtered asphalt particles;

adding a predetermined proportion of asphalt emulsion to the filtered asphalt particles;

mixing the filtered asphalt particles and the asphalt emulsion to generate a recycled mix;

depositing the recycled mix onto at least one of the binder course layer or an unmilled portion of the existing asphalt surface course layer; and finishing a new recycled surface course layer created by the deposited recycled mix, previously deposited onto the at least one of the binder course layer or the unmilled portion of the existing asphalt surface course layer.

* * * * *